US005322009A

United States Patent [19]

Retrum

[11] Patent Number: 5,322,009

[45] Date of Patent: Jun. 21, 1994

[54] APPARATUS FOR METERED INFEEDING, COMPACTING AS REQUIRED, AND PUMPING TO ELEVATED PRESSURE TOUGH LONG-STRANDED MATERIAL OF LITTLE FLUIDITY, SUCH AS RAW FEATHERS

[76] Inventor: Rowland Retrum, P.O. Box 389, Estes Park, Colo. 80517

[21] Appl. No.: 8,909

[22] Filed: Jan. 25, 1993

[51] Int. Cl.[5] ..... B30B 7/04

[52] U.S. Cl. ..... 100/96; 100/139; 100/142; 100/215; 100/232

[58] Field of Search ..... 100/96, 97, 137–143, 100/145, 215, 232, 249

[56] References Cited

U.S. PATENT DOCUMENTS

| | | | |
|---|---|---|---|
| 657,607 | 9/1900 | Luzatto | 100/141 X |
| 1,054,464 | 2/1913 | Soucek | 100/215 X |
| 3,161,124 | 12/1964 | Strömberg | 100/215 X |
| 3,426,673 | 2/1969 | Miner et al. | 100/138 X |
| 3,611,673 | 10/1971 | Carkhuff | 100/99 X |
| 3,625,138 | 12/1971 | Shinn et al. | 100/45 |
| 3,651,755 | 3/1972 | Gati | 100/96 |
| 3,805,689 | 4/1974 | Berger et al. | 188/215 X |
| 3,828,663 | 8/1974 | Poplinski | 100/42 |
| 3,830,150 | 8/1974 | Retrum | 100/145 X |
| 3,838,634 | 10/1974 | Alexandrov et al. | 100/50 |
| 4,040,230 | 8/1977 | Pessel et al. | 100/99 X |
| 4,055,203 | 10/1977 | Crawford et al. | 100/215 X |
| 4,099,457 | 7/1978 | Hyden | 100/42 |
| 4,108,063 | 8/1978 | Randolph | 100/232 X |
| 4,111,113 | 9/1978 | Lambert | 100/74 |
| 4,787,308 | 11/1988 | Newsom et al. | 100/50 |
| 5,111,741 | 5/1992 | Weder et al. | 100/45 |

*Primary Examiner*—Stephen F. Gerrity
*Attorney, Agent, or Firm*—John R. Flanagan

[57] ABSTRACT

An apparatus for metered infeeding, compacting as required, and pumping coarse material of little fluidity such as raw feathers includes infeed metering transferring compacting and pumping mechanisms. The infeed metering mechanism intermittently infeeds a slug of material being at original uncompressed bulk density and approximately equal to an amount of material required for each cycle of operation of the apparatus. The transferring mechanism has a rotatable screw conveyor operable for rapidly receiving and transferring the slug and a wiper arm mounted to a discharge end of the screw conveyor to rotate therewith and create a plane of cleavage in the material being discharged therefrom. The compacting mechanism has an elongated chute with an offset located adjacent the discharge end of the screw conveyor and a compactor reciprocally movable in the chute between retracted and extended positions. The chute is disposed in transverse relation to the screw conveyor for receiving the slug of material therefrom. The compactor pre-compresses the slug of material into an elongated cylinder of the pumping mechanism without the material jamming at any of the pinch-points in the chute. The discharge end of the compactor chute is coincident with an inlet opening in the side of a ram cylinder that is disposed transversely to the chute. A ram reciprocally movable in the cylinder from a retracted position to an extended position during each pumping cycle then further compresses the slug of material and ejects it from the cylinder.

15 Claims, 4 Drawing Sheets

APPARATUS FOR METERED INFEEDING, COMPACTING AS REQUIRED, AND PUMPING TO ELEVATED PRESSURE TOUGH LONG-STRANDED MATERIAL OF LITTLE FLUIDITY, SUCH AS RAW FEATHERS

BACKGROUND OF THE INVENTION

1. Field of the Invention

The present invention generally relates to the pumping of loose materials and, more particularly, is concerned with an apparatus and method for metered infeeding, compacting as required, and pumping coarse material of low fluidity.

2. Description of the Prior Art

A wide variety of materials are difficult to move by pumping for feeding these materials in their respective processing operations. These materials range from low-density materials requiring substantial pre-compression to higher-density material requiring little or no pre-compression. The low-density materials are typically bulky, fibrous or stringy, non-frangible, tough, non-fluid, wet or dry materials. An example of such low-density materials is feathers. The higher-density materials are typically coarse, lumpy, frangible or non-frangible, semi-fluid, heterogeneous, wet or dry materials. Representative examples of such higher-density materials are ground offal and wet hog hair.

One example of a process involving low-fluidity, low-density material requiring pre-compression is the steam hydrolyzation of feathers. One of the two continuous hydrolyzing systems in current use is exemplified by the hydrolyzing system disclosed in U.S. Pat. No. 3,617,313 to Harrington et al. This system employs an infeed pump which includes a variable-pitch screw that compresses feathers into a pressure-sealing plug, then ejects them into a pressurized mildly agitated hydrolyzing retort. The pump is dependent on the tightly knit compressed wad of feathers for the formation of the self-sealing plug. Since the screw is not a positive-displacement device, it loses its seal when liquid or plastic materials (often present in feathers) enter the pump. Blow-back that depressurizes the retort then occurs through the pump. As a result, the operation of the system is frequently interrupted, usually requiring shutdown and, often, disassembly for clean-out.

Also, in this system, the high-pressure squeezing action of the screw "wrings" free water out of the feathers, to the degree that live steam must be injected into the hydrolyzing retort in order to build adequate hydrolyzing pressure and supply the water needed for the hydrolyzing reaction. The injection of steam is very expensive because it is not returned to the boiler.

The other of the two continuous hydrolyzing systems in current use is exemplified by the hydrolyzing system disclosed in U.S. Pat. Nos. 4,231,926, 4,286,884, 4,378,311 and 4,497,733 to Retrum. This system employs two vigorously-agitated retorts and an intermediate pump. In the first non-pressurized retort of this system, the feathers are beaten to a coarse pulp at the atmospheric saturation temperature of water. The coarse pulp is then pumped via the intermediate pump into a second pressurized vigorously-agitated hydrolyzing retort. This system requires two vigorously-agitated retorts and a pump, which are expensive. This system is more economical in large installations than in the small installations which constitute most of the market.

Consequently, in view of the problems associated with the two currently-used continuous hydrolyzing systems, a need still exists for improvements in pumping difficult materials.

SUMMARY OF THE INVENTION

The present invention provides apparatus and method for metered infeeding, compacting as required, and pumping coarse material of low fluidity which are designed to satisfy the earlier-mentioned need. In contrast to the one of the other of the two currently-used systems, the apparatus and method of the present invention employs a positive-displacement device that does not depend on the physical character of the material for the containment of pressure nor require direct injection of expensive live steam into the retort. Instead, the device pressurizes the retort by evaporating the surface water entering the retort with the feathers, using more economical indirect heat from jacketed steam that is condensed and returned to the boiler.

Accordingly, the present invention is directed to an apparatus for metered infeeding, compacting as required, and pumping coarse material of low fluidity. The apparatus comprises an infeed metering mechanism, a transferring-loading mechanism, a compacting mechanism, and a pumping mechanism. The infeed metering mechanism is operable for intermittently infeeding a metered slug of material at an original uncompressed bulk density and approximately equal to an amount of material required for each cycle of operation. The transferring-loading mechanism has a rotatable transfer screw conveyor operable for rapidly receiving and transferring the slug of material to the compactor chute and a wiper arm mounted to a discharge end of the transfer screw conveyor to rotate therewith and create a plane of cleavage or separation at the discharge end of the transfer screw conveyor in the material being discharged therefrom. The compacting mechanism has an elongated chute and a compactor reciprocally movable in the chute between retracted and extended positions. The chute is disposed in transverse relation to the transfer screw conveyor for receiving the slug of material therefrom. The compactor is operable to move from a retracted position to an extended position to pre-compress the slug of material without jamming material at the intersection of the transfer conveyor and the compactor chute. The pumping mechanism has an elongated cylinder disposed in transverse relation to a discharge opening of the chute and a ram reciprocally movable in the cylinder from a retracted position to an extended position during each pumping cycle to further pre-compress the slug of material before fully compressing it within the pump cylinder and ejecting it at higher pressure.

Also, the present invention is directed to a method for metered infeeding, compacting as required, and pumping coarse material of low fluidity. The method comprises the steps of infeeding intermittently a metered slug of material being at original uncompressed bulk density and approximately equal to an amount of material required for each cycle of operation; receiving the slug of material and transferring the slug of material rapidly into a chute through a receiving opening therein; moving the slug of material from the receiving opening of the chute through a discharge opening thereof and pre-compressing the slug of material in a cylinder disposed in transverse relation to the discharge opening of the chute, without causing jamming of the slug of material in the chute at the receiving and discharge openings thereof; and pumping the pre-compressed slug of material through the cylinder from the area adjacent to the discharge opening of the chute during each pumping cycle to further compress the slug of material and eject it from the cylinder.

Alternatively, the infeed mechanism can be modified to accommodate materials of higher density and more fluidity, such as wet hog hair or ground offal, with little pre-compression required. Pre-compression of low-density, bulky material is necessary to achieve an economical charge per stroke of the reciprocating ram.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
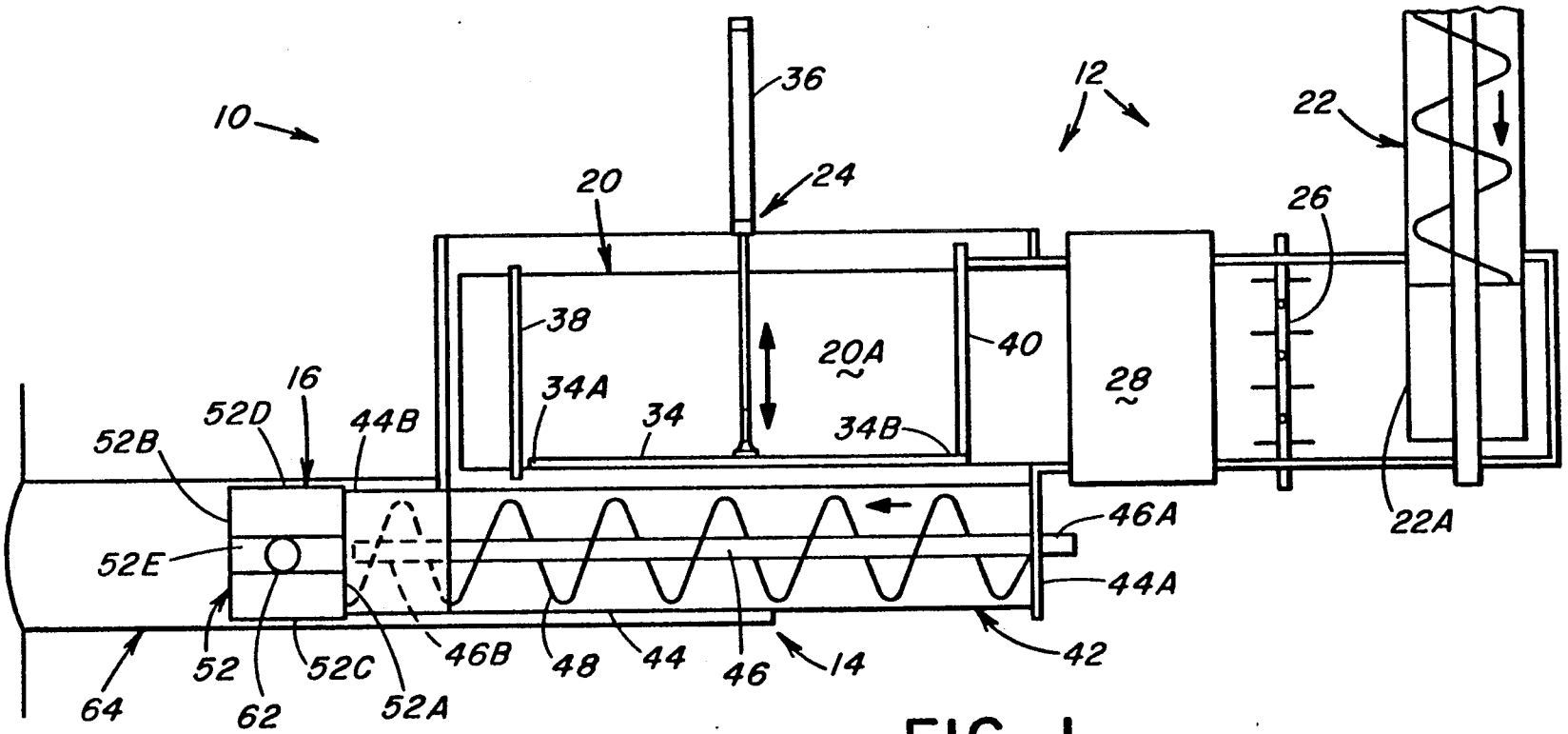
FIG. 1 is a schematic top plan view of an apparatus for metered infeeding, compacting as required, and pumping coarse material of low fluidity, in accordance with the present invention.
Figure 2:
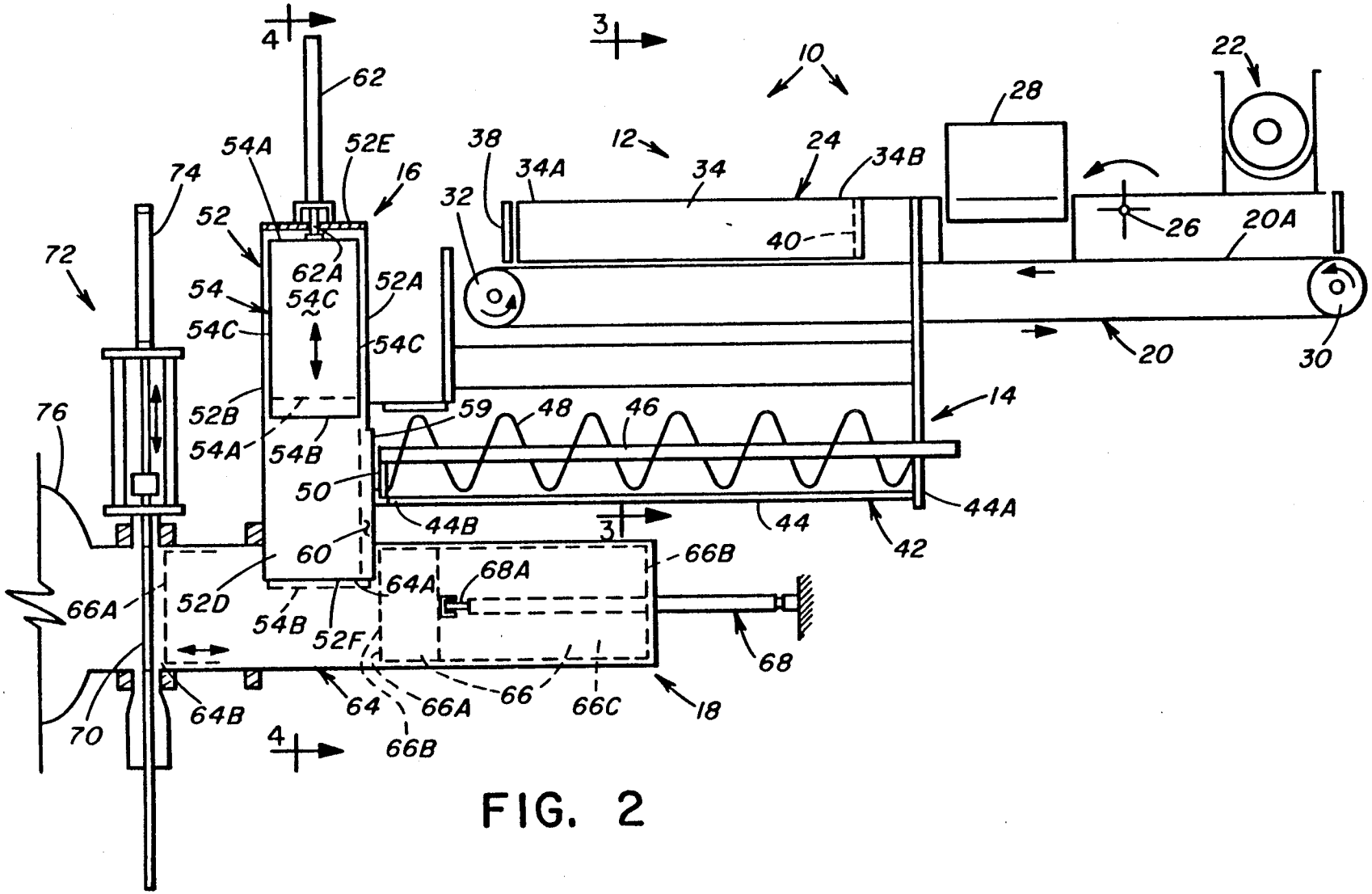
FIG. 2 is a schematic side elevational view of the apparatus of FIG. 1, showing the infeed metering mechanism, transferring-loading mechanism, compacting mechanism and pumping mechanism of the apparatus.

Referring to the drawings, and particularly to FIGS. 1 and 2, there is illustrated an apparatus, generally designated 10, for metered infeeding, compacting, and pumping of a variety of material in accordance with the principles of the present invention. The apparatus 10 can handle a wide variety of materials ranging from (Type A) low-density, bulky, fibrous or stringy, non-frangible, tough, non-fluid, wet or dry materials requiring substantial pre-compression, to (Type B) higher-density, coarse, lumpy, frangible or non-frangible, semi-fluid, heterogeneous, wet or dry materials requiring little or no pre-compression. An example of Type A material is wet or dry feathers. Some examples of Type B materials are wet hog hair and ground offal. The apparatus 10 basically includes an infeed metering mechanism 12, a transferring-loading mechanism 14, a compacting mechanism 16, and a pumping mechanism 18.

Figure 3:
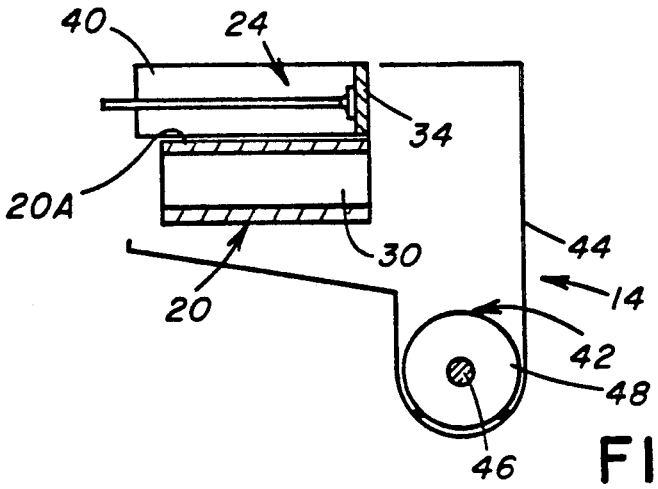
FIG. 3 is a cross-sectional view of the apparatus taken along line 3—3 of FIG. 2, showing an endless belt and reciprocal belt sweep of the infeed metering mechanism and a transfer screw conveyor of the transferring mechanism.

Referring to FIGS. 1-3, the infeed metering mechanism 12 of the apparatus 10 is operable for intermittently infeeding a slug of material being at original uncompressed bulk density and selected to be approximately equal to an amount of material required for each cycle of operation of the apparatus 10. In the illustrated embodiment, the infeed metering mechanism 12 includes an elongated endless belt 20, an infeed screw conveyor 22 mounted adjacent to an upstream end portion of the endless belt 20, a reciprocal belt sweep 24 mounted adjacent to a downstream end portion of the endless belt 20, and a rotary screed 26 and an electromagnet 28 disposed side-by-side and between the screw conveyor 22 and the reciprocal belt sweep 24. The endless belt 20 is entrained about a pair of spaced apart rollers 30, 32 and driven about an endless path by a suitable power source (not shown) such that an upper span 20A of the endless belt 20 moves from under a discharge end 22A of the infeed screw conveyor 22 to under the reciprocal belt sweep 24.

To accomplish intermittent adjustable infeed of slugs of material at original uncompressed bulk density and matching the amounts required for each pumping cycle, the endless belt 20 is moved at a relatively slow speed as the material is dropped continuously onto the endless belt 20. The material on the belt, 20 is then screeded by the rotary screed 26 into a layer form having a uniform shallow depth for removal of tramp metal by the electromagnet 28.

The material is then periodically pushed off the endless belt 20 into the transferring mechanism 14 by the reciprocal belt sweep 24. The reciprocal belt sweep 24 includes a pusher member 34 extending parallel to the direction of travel of the endless belt 20 and movable by a first hydraulic actuator 36 through an extended forward stroke and a retracted reverse stroke across the downstream end portion of the belt 20 to discharge the slug of material therefrom. A first fixed stop member 38 extends across the belt 20 adjacent to the downstream end 34A of the pusher member 34 to prevent material from being carried over the downstream roller 32 on the continuously-moving endless belt 20. A second stop member 40 is attached to the upstream end 34B of the pusher member 34 for movement therewith to prevent material from being carried behind the pusher member 34 on the continuously-moving endless belt 20 as the pusher member 34 is moved through its forward and reverse strokes.

Referring to FIGS. 1-3, the transferring mechanism 14 of the apparatus 10 is operable for receiving the slug of material from the above-described infeed metering mechanism 12 and rapidly transferring the slug of material into the compacting mechanism 16. The transferring mechanism 14 includes an elongated transfer screw conveyor 42 constructed of an elongated semi-cylindrical trough 44 having a closed upstream end 44A and an open downstream end 44B, an elongated central shaft 46 and a helical flighting 48 extending about and attached along the central shaft 46 and along the cylindrical trough 44. The central shaft 46 is rotatably mounted at its upstream end 46A to the closed upstream end 44A of the trough 44 but constrained loosely within longitudinal splines at its downstream end 46B. The transfer screw conveyor 42 is rotatably driven by a suitable power source (not shown). The transferring mechanism 14 also includes a wiper arm 50 attached to the downstream end 46B of the central shaft 46 and to the leading radial edge 48A of the helical flight 48 at the discharge end of the transfer screw conveyor 42.

The transfer screw conveyor 42, continuously rotating at relatively high speed, is operable for receiving and transferring the slug of material from the infeed metering mechanism 12 to the compacting mechanism 16. The wiper arm 50, rotating with the transfer screw conveyer 42, creates a transverse plane of cleavage or separation at the discharge end of the transfer screw conveyor 42 which produces discontinuity of the flow of the material being discharged therefrom to the compacting mechanism 16. The wiper arm 50 rotates freely with the screw conveyor 42 and creates the cleavage plane by pushing material to both sides of its circular path. The cleavage in the material is effective to prevent jamming of material at the interface between the transferring and compacting mechanisms 14, 16.

Referring to FIGS. 1, 2, 4 and 5, the compacting mechanism 16 of the apparatus 10 includes an elongated chute 52 and a compactor 54 reciprocally movable in the chute 52 between retracted and extended positions. The compactor 54 is operable for moving the slug of material from a receiving opening 56 of the chute 52 through the chute 52 to a discharge opening 58 thereof so as to progressively pre-compress the slug of material to an intermediate density as it is advanced through the chute 52 and into the pumping mechanism 18 without causing jamming of the slug of material in the chute 52 at the material receiving and discharge openings 56, 58 of the chute 52.

The chute 52 is constructed of a pair of opposite side walls 52A, 52B and a pair of front and rear walls 52C, 52D connected together along their longitudinal edges to define a substantially rectangular cross-sectional configuration. The chute 52 is open at its bottom end which defines the discharge opening 58. The chute 52 is disposed in transverse relation to the transfer screw conveyor 42 with the material receiving opening 56 defined in the one side wall 52A contiguous with the open downstream discharge end 44B of the transfer screw conveyor 42 for receiving the slug of material therefrom.

Figure 5:
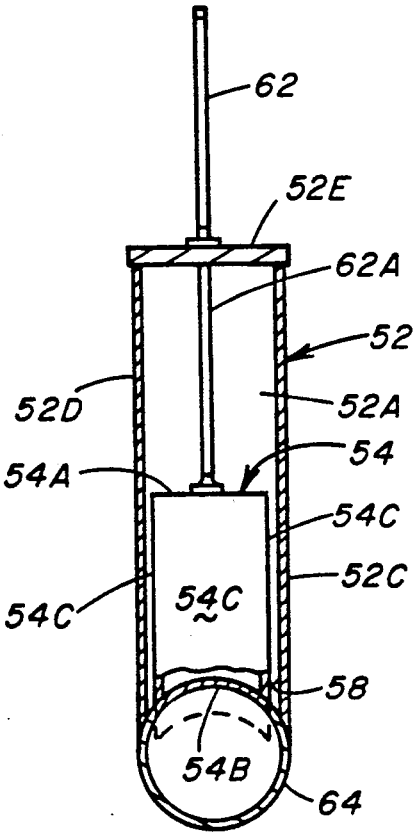
FIG. 5 is a view similar to that of FIG. 4, but showing the compactor of the compacting mechanism at an extended position.
Figure 4:
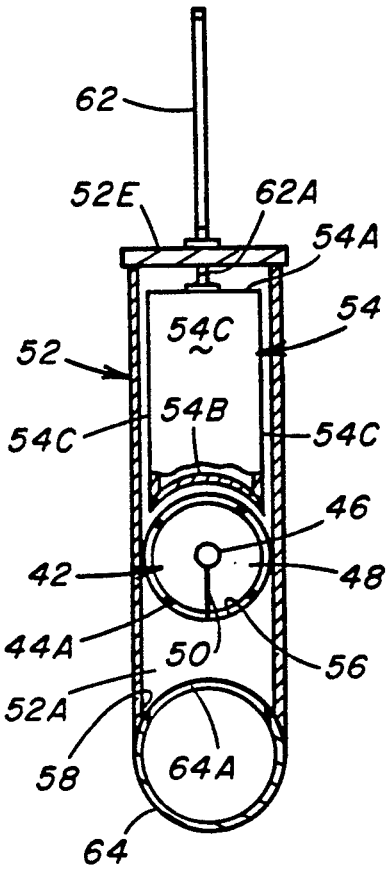
FIG. 4 is a cross-sectional view of the apparatus taken along line 4—4 of FIG. 2, showing the transfer screw conveyor of the transferring mechanism, the cylinder of the pumping mechanism, and the chute and compactor of the compacting mechanism with the compactor at a retracted position.

The compactor 54 preferably is an elongated rigid body of hollow or solid construction having a rectangular cross-sectional configuration and mounted within the chute 52 for slidable movement from an upper retracted position, as shown in FIG. 4, to a lower extended position, as shown in FIG. 5. The elongated compactor body 54 has a pair of spaced opposite upper and lower ends 54A, 54B and a plurality of interconnected sidewalls 54C extending between and connected with the opposite upper and lower ends 54A, 54B. As readily seen in FIG. 2, the chute 52 is somewhat enlarged in cross-sectional size on its infeed side from the lower part of the material receiving opening 56 thereof to provide an offset 59 in the infeed side of the chute 52 which creates a gap 60 of sufficient size between the offset infeed side 59 of the chute 52 and adjacent one of the sidewalls 54C of the compactor 54 to prevent material from jamming between the one side wall 52A of the chute 52 and the adjacent one sidewall 54C of the compactor 54.

The compacting mechanism 16 also includes a second hydraulic actuator 62 mounted upon a cross member 52E across the open top of the chute 52 and upon actuation has a piston rod 62A extendable into the chute 52. The piston rod 62A of the second hydraulic actuator 62 is connected to the upper end 54A of the compactor 54 and is operable to movably drive the compactor 54 through forward and reverse strokes relative to the chute 52 between the extended and retracted positions in order to pre-compress and advance the slug of material therefrom. In its retracted position, the compactor 54 is located above the material receiving opening 56 of the chute 52.

Referring to FIGS. 1, 2 and 5, the pumping mechanism 18 of the apparatus 10 includes an elongated hollow cylinder 64 disposed in transverse relation to the compactor chute 52 and a ram 66 reciprocally movable in the cylinder 64 by operation of a third hydraulic cylinder 68 from a retracted position R to an extended position E, as seen in FIG. 2, during each cycle of operation of the apparatus 10. The cylinder 64 has a material inlet opening 64A in an upper side thereof which is contiguous with the material discharge opening 52F in the lower end of the chute 52. The cylinder 64 also has a material outlet opening 64B at one end of the cylinder opposite from the ram 66. The ram 66 is an elongated body provided in a close fitting relationship with the cylinder 64 so as to be capable of producing a pumping action against the pre-compressed slug of material received therein which further compresses the material to an elevated pressure as the ram 66 moves relative to and with the cylinder 64 from the retracted position to the extended position during each cycle of operation of the apparats 10. The elongated ram body 66 has a pair of spaced front and rear ends 66A, 66B and a cylindrical sidewall 66C extending between and connected with the opposite front and rear ends 66A, 66B.

The compactor 54 has a concave lower end surface on the lower end 54B thereof which corresponds in curvature to the material inlet opening 64A of the cylinder 64 into which the compactor 54 discharges the pre-compressed slug of material. In the case of handling loose fibrous springy material (Type A), the compactor 54 is preferably moved such that its lower end 54B initially overtravels the extended position so as to extend a short distance beyond the discharge opening 52F of the chute 52 and through the inlet opening 64A of the cylinder 64 to impart an additional amount of compression to the material in the cylinder 64. Then, preparatory to pumping the material from the cylinder 64, the compactor 54 is retracted a short distance to place its lower concave end surface on the lower end 54B thereof across the cylinder inlet opening 64A so as to complete the tubular formation of the cylinder 64. The initial overtravel of the compactor 54 is preferred to compress the low density elastic Type A material wholly within the cylinder 64 in order to properly position it for the final pumping operation. It will be realized that the upper end 54A of the compactor 54 is located above the top of the offset 59 in the infeed side of the chute 52 when the compactor 54 is at rest at the extended position shown in dashed outline form in FIG. 2. Thus, the one of the sidewalls 54C of the compactor 54 contiguous with the offset infeed side 59 of the chute 52 blocks any material from entering above the upper end 54A of the compactor 54 from the region of the gap 60 produced by the offset infeed side 59 of the chute 52.

In the retracted position R, the front end 66A of the ram 66 is disposed to the right of the material inlet opening 64A of the cylinder 64 as viewed in FIG. 2. To pump the slug of material from the cylinder 64, the third hydraulic cylinder 68 whose piston rod 68A is connected to the rear end 66B of the ram 66 is extended to the left as viewed in FIG. 2, moving the ram 66 along a forward stroke past the inlet opening 64A and toward the outlet opening 64B of the cylinder 64 without causing material jamming at the forward edge of the inlet opening 64A because of the closure of the inlet opening 64A and continuous completion of the tubular formation of the cylinder 64 by the concave end surface 54B of the compactor 54 in the extended position. The ram 66 further compresses the material to a final density into the outlet end 64B of the cylinder 64 and ejects it therefrom at the same or increased pressure after a plate-like gate 70 of a discharge valve mechanism 72 is lifted by a fourth hydraulic actuator 74 of the valve mechanism 72. By moving to a final extended position E close to the valve mechanism 72, the gate 70 of the valve mechanism 72 can be lifted and lowered to open and close the outlet opening 64B of the cylinder 64 so as to permit the compressed slug of material to be ejected from the cylinder 64 through the outlet opening 64B and into a pressurized retort chamber 76 without causing blowback of high-pressure vapor contained between valve 70 and ram 66 when ram 66 is retracted to inlet opening 64A after closure of valve 70. It will be realized that the rear end 66B of the ram 66 is located to the right of the material inlet opening 64A in the upper side of the cylinder 64 when the ram 66 is at rest at the extended position also shown in dashed outline form in FIG. 2. Thus, the upper side of the sidewall 66C of the ram 66 which is contiguous with the material inlet opening 64A of the cylinder 64 blocks any material from entering behind the rear end 66B of the ram 66.

From the foregoing description with reference to FIGS. 1 and 2, it will be realized that materials of Type A are infed and metered by being periodically pushed off the endless belt 20 into the transfer screw conveyor 42 by the reciprocal belt sweep 24. Materials of Type B having sufficient density and fluidity can be discharged continuously and directly from the discharge end of a screeding conveyor such as belt 20 into the transfer screw conveyor 42, bypassing the need for the belt sweep 24. The controlled intermittent infeed of Type B materials is accomplished when the compactor 54 periodically descends and blocks off the receiving opening 56 into the compactor chute 52. Also, the helical flighting 48 of the transfer screw conveyor 42 is sufficiently relieved relative to the trough 44 to allow slippage between the flighting 48 and the material without jamming when the compactor 54 descends and blocks off the receiving opening 56 into the compactor chute 54, thus directly accomplishing controlled intermittent infeed.

Figure 6:
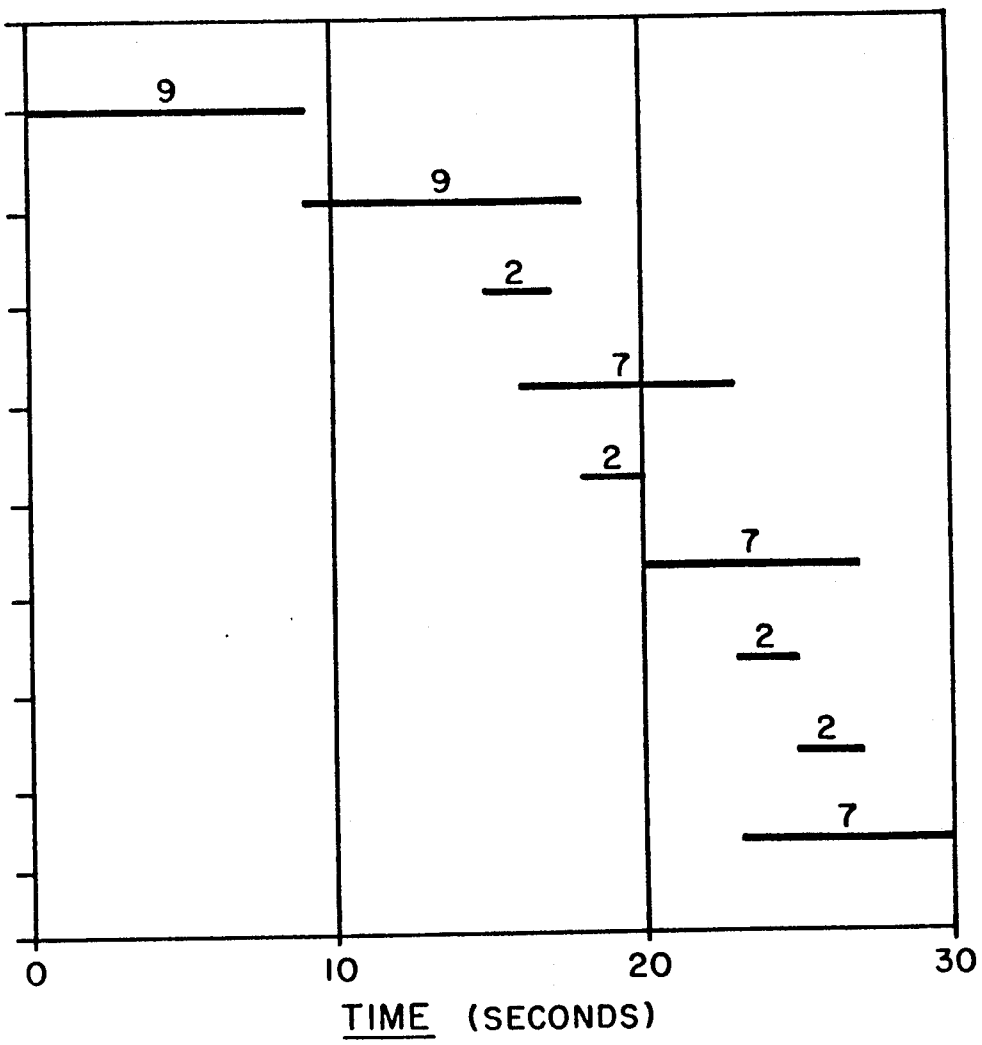
FIG. 6 is a bar chart showing the relative time durations of the various operations performed by the mechanisms of the apparatus of FIGS. 1 and 2.

FIG. 6 is a self-explanatory bar chart showing one pattern of control of the relative time durations and sequence of occurrence of the above-described operations performed by the infeed metering mechanism 12, transferring-loading mechanism 14, compacting mechanism 16, pumping mechanism 18 of the apparatus 10 of FIGS. 1 and 2 and by the valve mechanism 72, for Type A materials. Alternatively, for example, the return of the compactor 54 to the retracted position (and subsequent operations) may be delayed until the ram 66 has first been returned to its retracted position.

In summary, the apparatus 10 is operable to pre-compress material as required to produce an economical charge for each cycle of operation of the apparatus and then pump and compress the charge of material to a higher pressure. Also, the apparatus 10 does not require that the material handled have a low elastic limit or take on a set when compacted. Further, the apparatus 10 avoids the binding and jamming that normally occurs at pinch-points with tough, stringy material. Finally, the apparatus 10 has a pumping mechanism 18 that is a genuine pump that can pump against pressure, although it cannot generate flow in a pipeline unless the material itself is fluid.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An apparatus for infeeding, compacting as required, and pumping to elevated pressure coarse material of little fluidity including tough long-strand material including raw feathers, said apparatus comprising:

(a) an infeed metering mechanism operable for intermittently infeeding a metered slug of material being at an original uncompressed bulk density and approximately equal to an amount of material required for a given cycle of operation of said apparatus, said infeed metering mechanism including (i) means for receiving the metered slug of material at one end thereof and moving the slug of material progressively in a first direction of travel toward an opposite end thereof and for spreading the metered slug of material into a layer form having a substantially uniform thickness as the slug of material is progressively moved toward said opposite end, and (ii) means for moving the layered metered slug of material in a second direction of travel being substantially transversely oriented to said first direction of travel to discharge the layered metered slug of material from a side of said receiving and spreading means extending between said one end and said opposite end thereof;

(b) a transferring mechanism including a rotatable transfer screw conveyor extending along said side of said receiving and spreading means and having a receiving side and a discharge end, said transfer screw conveyor being operable for receiving at said receiving side thereof the layered metered slug of material discharged from said side of said receiving and spreading means and transferring and discharging the layered metered slug of material at the original uncompressed bulk density at said discharge end of said transfer screw conveyor;

(c) a compacting mechanism disposed in transverse relation to said transfer screw conveyor and having a receiving opening disposed in contiguous relation to said discharge end of said transfer screw conveyor for receiving the slug of material therefrom, said compacting mechanism being operable to pre-compress the slug of material to an intermediate bulk density and move the slug of material to a discharge opening in said compacting mechanism; and (d) a pumping mechanism disposed in transverse relation to said compacting mechanism and having a material inlet opening contiguous with said discharge opening in said compacting mechanism, said pumping mechanism being operable during each operating cycle of said apparatus to further compress and increase the pressure of the slug of material to a final bulk density and to eject it from said apparatus at elevated pressure.

2. The apparatus of claim 1 wherein:

said receiving and spreading means includes a moving belt and a screed device spaced above said belt; and said moving means includes a reciprocal sweep movable across and above said moving belt.

3. The apparatus of claim 1 wherein said compacting mechanism includes:

an elongated hollow chute extending from adjacent to said discharge end of said transfer screw conveyor to said inlet opening of said pumping mechanism; and a compactor reciprocally movable in said chute between retracted and extended positions past said discharge end of said transfer screw conveyor, said chute being disposed in transverse relation to said transfer screw conveyor for receiving the slug of material therefrom, said compactor being operable to pre-compress the slug of material to an intermediate bulk density and move the slug of material toward said discharge opening of said chute.

4. An apparatus for infeeding, compacting as required, and pumping to elevated pressure coarse material of little fluidity including tough, long-strand material including raw feathers, said apparatus comprising:

(a) a transferring mechanism including a rotatable transfer screw conveyor having a discharge end and being operable for rapidly receiving and transferring a slug of material and discharging the slug of material at an original uncompressed bulk density at said discharge end of said transfer screw conveyor, said transfer screw conveyor including a central shaft and a helical flighting extending about and attached along said central shaft;

(b) a compacting mechanism including an elongated chute disposed in transverse relation to said transfer screw conveyor and having a discharge opening in an end thereof and a receiving opening in a side portion thereof disposed in contiguous relation to said discharge end of said transfer screw conveyor for receiving the slug of material therefrom through said receiving opening, said compacting mechanism also including an elongated compactor body reciprocally movable in said chute between an upper retracted position and a lower extended position past said receiving opening of said chute and said discharge end of said transfer screw conveyor, said compactor body being operable to pre-compress the slug of material received in said chute form said transfer screw conveyor to an intermediate bulk density and move the slug of material to said discharge opening of said chute; and (c) a pumping mechanism disposed in transverse relation to said compacting mechanism an having a material inlet opening contiguous with said discharge opening at said end of said chute of said compacting mechanism, said pumping mechanism being operable during each operating cycle of said apparatus to further compress and increase the pressure of the slug of material to a final bulk density and to eject it from said apparatus at elevated pressure;

(d) said transferring mechanism also including means for creating a plane of cleavage at said discharge end of said transfer screw conveyor and at said receiving opening of said chute of said compacting mechanism contiguous therewith, said plane of cleavage being defined through the slug of material being discharge form said transfer screw conveyor so as to create discontinuity of the flow of the slug of material discharging form said transfer screw conveyor into said chute of said compacting mechanism to prevent jamming of tough long-strand material including feathers between a leading edge of said compactor body of said compacting mechanism and a bottom edge of said receiving opening of said chute thereof as said compactor body moves from said upper retracted position to said lower extended position, said cleavage plane creating means being a wiper arm extending in transverse relation to said central shaft of said transfer screw conveyor and fixed to said transfer screw conveyor at said discharge end thereof and disposed contiguous to said receiving opening of said compacting mechanism so as to rotate with said transfer screw conveyor and create said plane of cleavage at said discharge end of said transfer screw conveyor in the material being discharged therefrom through said receiving opening into said chute of said compacting mechanism by pushing material to both sides of its circular path, at the point of entry into said chute of said compactor mechanism through said receiving opening thereof.

5. The apparatus of claim 4 wherein said chute has a side portion containing said receiving opening and being located adjacent to said discharge end of said transfer screw conveyor, and extending from said receiving opening to said pumping mechanism; said side portion of said chute being offset outwardly relative to an upper portion of said chute to create a gap of sufficient width between said chute side portion and said compactor to prevent jamming of tough long-strand material including raw feathers between a leading edge of said compactor and a bottom edge of said receiving opening in said side portion of said chute adjacent said discharge end of said transfer screw conveyor.

6. An apparatus for infeeding, compacting as required, and pumping to elevated pressure coarse material of little fluidity including tough long-strand material including raw feathers, said apparatus comprising:

(a) a transferring mechanism including a rotatable transfer screw conveyor having a discharge end and being operable for rapidly receiving and transferring a slug of material and discharging the slug of material at an original uncompressed bulk density at said discharge end of said transfer screw conveyor;

(b) a compacting mechanism disposed in transverse relation to said transfer screw conveyor and having a receiving opening disposed in contiguous relation to said discharge end of said transfer screw conveyor for receiving the slug of material therefrom, said compacting mechanism being operable to pre-compress the slug of material to an intermediate bulk density and move the slug of material to a discharge opening in said compacting mechanism; and (c) a pumping mechanisms disposed in transverse relation to said compacting mechanism and having a material inlet opening contiguous with said discharge opening in said compacting mechanism, said pumping mechanism being operable during each operating cycle of said apparatus to further compress and increase the pressure of the slug of material to a final bulk density and to eject it form said apparatus at elevated pressure;

(d) said compacting mechanism including (i) an elongated hollow chute extending from adjacent to said discharge end of said transfer screw conveyor to said inlet opening of said pumping mechanism, said chute having said receiving opening defined in a side portion thereof located contiguous with and adjacent to said discharge end of said transfer screw conveyor and extending between said transferring mechanism and said pumping mechanism, and (ii) a compactor having opposite lower and upper ends and a plurality of sidewalls extending between and connected with said upper and lower ends, said compactor being reciprocally movable in said chute between retracted and extended positions in which said lower end of said compactor moves respectively downwardly and upwardly past said receiving opening of said chute and said discharge end of said transfer screw conveyor, said chute being disposed in transverse relation to said transfer screw conveyor for receiving the slug of material therefrom through said receiving opening, said compactor being operable to pre-compress the slug of material to an intermediate bulk density and move the slug of material toward said discharge opening of said chute, (iii) said side portion of said chute containing said receiving opening being enlarged relative to the remainder of said chute so as to provide an offset in said side portion of said chute which is spaced at a greater distance from an adjacent one of sad sidewalls of said compactor than is the remainder of said chute spaced from said other sidewalls of said compactor and thereby create a gap of sufficient width between said side portion of said chute and said adjacent one sidewall of said compactor extending downwardly from said discharge opening of said transfer screw conveyor to said inlet opening of said pumping mechanism to prevent jamming of tough long-strand material including raw fathers at said discharge end of said transfer screw conveyor between a bottom edge of said receiving opening in ad side portion of said chute and a leading edge formed by said lower end and said adjacent one sidewall of said compactor.

7. The apparatus of claim 6 wherein said pumping mechanisms includes:

an elongated cylinder having an end outlet opening and a side inlet opening and being disposed in transverse relation to said compacting mechanism with said inlet opening contiguous with said discharge opening of said compacting mechanism; and a ram including an elongated body closely fitted within said cylinder and having a pair of spaced front and rear ends and a substantially cylindrical sidewall extending between and connected with the opposite front and rear ends, said ram body being reciprocally movable in said cylinder from a retracted position to an extended position during the given cycle of operation of said apparatus in which said cylindrical sidewall of said ram moves relative to and covers said discharge opening of said chute of said compacting mechanism and said side inlet opening of said cylinder and moves in sad close fitting relation with said cylinder to provide a pumping action which further compresses and increases the pressure of the slug of material to the final bulk density and ejects the slug of material from said cylinder at elevated pressure.

8. The apparatus of claim 7 wherein said compactor has a concave end surface corresponding in curvature to said side inlet opening of said cylinder such that int he extended position of said compactor said concave end surface thereof extends across said side inlet opening of said cylinder so as to complete formation of said cylinder and close said side inlet opening thereof.

9. An apparatus for metered infeeding, compacting as required, and pumping to elevated pressure coarse material of little fluidity including tough, long-strand material including raw feathers, said apparatus comprising;

(a) an infeed metering mechanism operable for intermittently infeeding a metered slug of material of substantially uniform thickness and at an original uncompressed bulk density and approximately equal to an amount of material required for a given cycle of operation of said apparatus;

(b) a transferring mechanism having a rotatable transfer screw conveyor disposed at a side thereof along a side of said infeed metering mechanism for rapidly receiving the slug of material therefrom and being operable for transferring the slug of material to a discharge end of said transfer screw conveyor, said transferring mechanism also having means for creating a plane of cleavage at said discharge end of said transfer screw conveyor to provide discontinuity in the flow of the slug of material being discharge therefrom;

(c) a compacting mechanism having an elongated hollow chute and a compactor reciprocally movable in said chute between retracted and extended positions, said hollow chute having an end discharge opening and a side receiving opening contiguous with said discharge end of said transfer screw conveyor, said compactor being operable to move form said retracted position to said extended position to pre-compress the slug of material to an intermediate bulk density int he chute and move the slug of material toward said discharge opening of said chute; and (d) a pumping mechanism including an elongated cylinder having an end outlet opening and a side inlet opening and being disposed in transverse relation to said compacting mechanism with sad inlet opening contiguous with said discharge opening of said chute of said compacting mechanism to receive the slug of material into said inlet opening of said cylinder from said discharge opening of said chute, said pumping mechanism also including a ram having an elongated body defined by a pair of spaced front and rear ends and a substantially cylindrical sidewall extending between and connected with the opposite front and rear ends and closely fitted within said cylinder, said ram body being reciprocally movable in said cylinder from a retracted position to an extended position during the given cycle of operation of said apparatus in which said cylindrical sidewall of said ram moves relative to and covers the discharge opening of said chute of said compacting mechanism and the side inlet opening of the cylinder and moves in said close fitting relation with said cylinder to provide a pumping action which further compresses and increases the pressure of the slug of material to a final bulk density and ejects the slug of material from the cylinder at elevated pressure.

10. The apparatus of claim 9 wherein:

said transfer screw conveyor includes a central shaft and a helical flighting extending about and attached along said central shaft; and said cleavage plane creating means includes a wiper arm extending in transverse relation to said central shaft and mounted to said discharge end of said transfer screw conveyor and disposed contiguous to said side receiving opening of said hollow chute of said compacting mechanism so as to rotate with said transfer screw conveyor and create said plane of cleavage at said discharge end of said transfer screw conveyor in the material being discharged therefrom through said receiving opening into said hollow chute of said compacting mechanism.

11. The apparatus of claim 9 wherein said hollow chute extends form adjacent to said discharge end of said transfer screw conveyor to said inlet opening of said cylinder of said pumping mechanism, said chute being disposed in transverse relation to said transfer screw conveyor for receiving the slug of material therefrom.

12. The apparatus of claim 11 wherein said chute has a side portion containing said receiving opening and being located adjacent to said discharge end of said transfer screw conveyor, and extending from said receiving opening to said pumping mechanism, sad side portion of said chute being offset outwardly relative to an upper portion of said chute to create a gap of sufficient width between said chute side portion and said compactor to prevent jamming of tough long-strand material including raw feathers between a leading edge of said compactor and a bottom edge of said receiving opening in said side portion of said chute adjacent to said discharge end of said transfer screw conveyor.

13. The apparatus of claim 11 wherein said compactor has an end surface corresponding in shape to said inlet opening of said cylinder such that in the extended position of said compactor said end surface thereof extends across said inlet opening of said cylinder so as to complete formation of said cylinder and close said side inlet opening thereof.

14. The apparatus of claim 9 wherein said infeed metering mechanism includes:

means for receiving the metered slug of material at one end thereof and moving the slug of material progressively in a first direction of travel toward an opposite end thereof and for spreading the metered slug of material into a layer form having a substantially uniform thickness as the slug of material is progressively moved toward said opposite end; and means for moving the layered metered slug of material in a second direction of travel being substantially transversely oriented to said first direction of travel to discharge the layered metered slug of material form a side of said receiving and spreading means extending between said one end and said opposite end thereof.

15. The apparatus of claim 9 wherein said compactor has a concave end surface corresponding in curvature to said side inlet opening of said cylinder such that int he extended position of said compactor said concave end surface thereof extends across said side inlet opening of said cylinder so as to complete formation of said cylinder and close said side inlet opening thereof.

* * * * *